US005774984A

United States Patent [19]

Kotani

[11] Patent Number: 5,774,984

[45] Date of Patent: Jul. 7, 1998

[54] METHOD OF MANUFACTURING A ROCKER ARM

[75] Inventor: Kazuyuki Kotani, Osaka, Japan

[73] Assignee: Koyo

[21] Appl. No.: 831,517

[22] Filed: Apr. 1, 1997

Related U.S. Application Data

[62] Division of Ser. No. 621,706, Mar. 26, 1996, Pat. No. 5,642,693, which is a continuation of Ser. No. 271,778, Jul. 7, 1994, abandoned.

[30] Foreign Application Priority Data

Jul. 7, 1993 [JP] Japan ..... 5-167791

[51] Int. Cl.[6] ..... B23P 15/00

[52] U.S. Cl. ..... 29/888.2; 29/428; 74/519; 74/559; 123/90.39

[58] Field of Search ..... 123/90.39, 90.4, 123/90.41, 90.42, 90.43, 90.44, 90.45, 90.46, 90.47; 74/519, 559; 29/888.2

[56] References Cited

U.S. PATENT DOCUMENTS

| | | | |
|---|---|---|---|
| 2,199,914 | 5/1940 | Haberstump | 74/519 |
| 3,096,749 | 7/1963 | Davidson | 123/90.39 |
| 3,222,950 | 12/1965 | Winter, Jr. | 74/519 |
| 3,418,985 | 12/1968 | Hirose | 123/90.39 |
| 4,346,678 | 8/1982 | Wherry | 123/90.44 |
| 4,697,473 | 10/1987 | Patel | 74/519 |
| 4,825,717 | 5/1989 | Mills | 74/519 |
| 4,829,647 | 5/1989 | Anderson et al. | 29/888.2 |
| 4,940,048 | 7/1990 | Mills | 123/90.39 |
| 4,979,475 | 12/1990 | Mills | 123/90.39 |
| 5,010,857 | 4/1991 | Hempelmann et al. | 123/90.39 |
| 5,016,582 | 5/1991 | Mills | 123/90.39 |
| 5,048,475 | 9/1991 | Mills | 123/90.39 |
| 5,060,606 | 10/1991 | Hubbard | 123/90.39 |
| 5,190,000 | 3/1993 | Van Schaik et al. | 123/90.39 |
| 5,207,191 | 5/1993 | Pryba et al. | 123/90.39 |
| 5,251,585 | 10/1993 | Gräber | 123/90.39 |
| 5,372,097 | 12/1994 | Joseph et al. | 123/90.36 |

FOREIGN PATENT DOCUMENTS

| | | |
|---|---|---|
| 0 573 674 | 12/1993 | European Pat. Off. . |
| 57-20509 | 2/1982 | Japan . |
| 58-152503 | 10/1983 | Japan . |
| 63-272903 | 11/1988 | Japan . |
| 5-179907 | 7/1993 | Japan . |
| 6-108809 | 4/1994 | Japan . |

*Primary Examiner*—Weilun Lo
*Attorney, Agent, or Firm*—Reid & Priest L.L.P.

[57] ABSTRACT

A method of manufacturing a rocker arm includes blanking a piece of plate to obtain a base material for forming a rocker arm body, the base material being substantially U-shaped in plan view and having two protrusions which are substantially in parallel with each other. The base material is bent until the two protrusions are confronted substantially in parallel with each other, to provide a pair of side walls having a coupling portion between the side walls. Next, the coupling portion is curved between the side walls to provide a valve engaging portion, and the free end portions of the side walls are fixedly secured to the side walls of a pivot engaging member which is a plat plate having a semi-spherical portion formed by drawing.

10 Claims, 4 Drawing Sheets

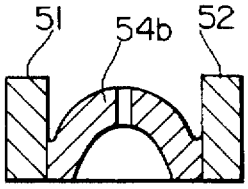
FIG. 5
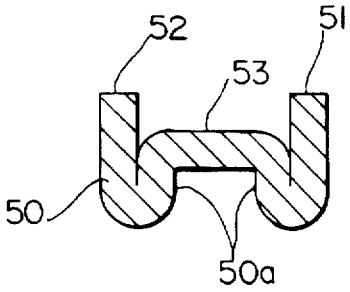
FIG. 6
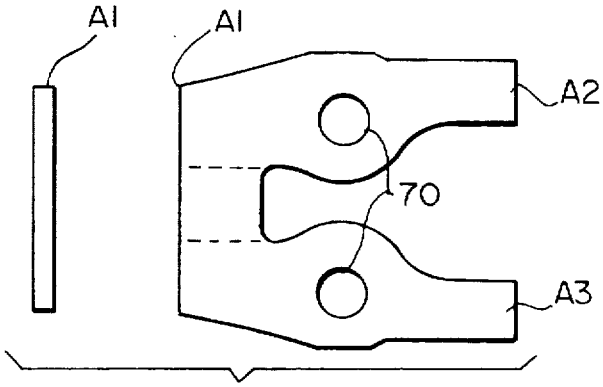
FIG. 7(a)
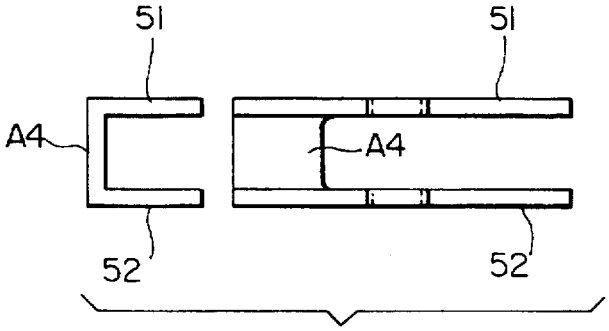
FIG. 7(b)
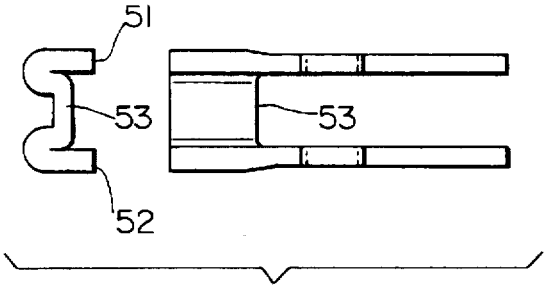
FIG. 7(c)
FIG. 7(d)
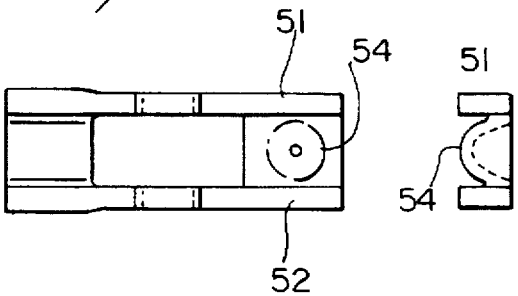

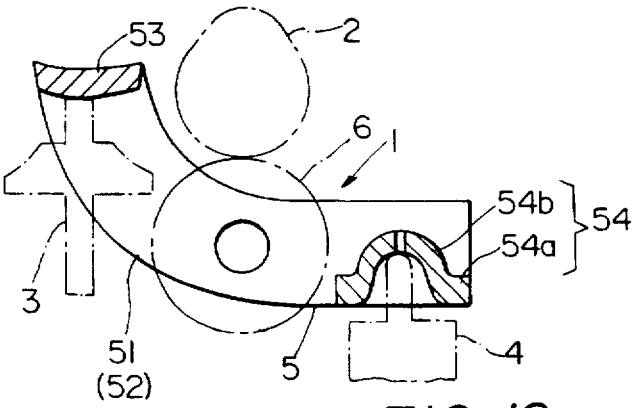
FIG. 12
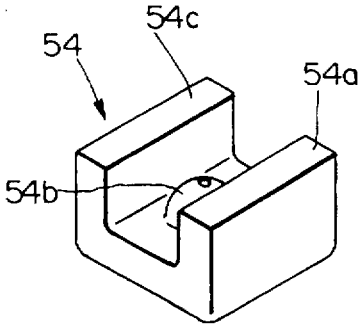
FIG. 13
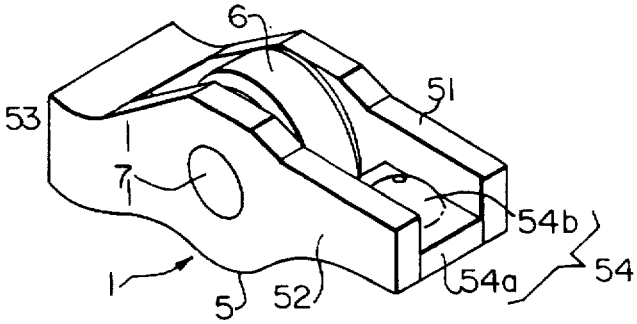
FIG. 14
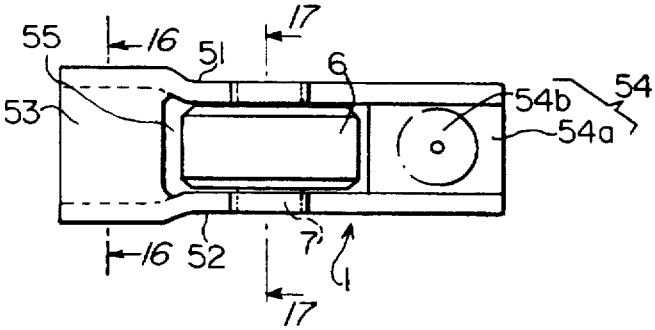
FIG. 15
FIG. 16
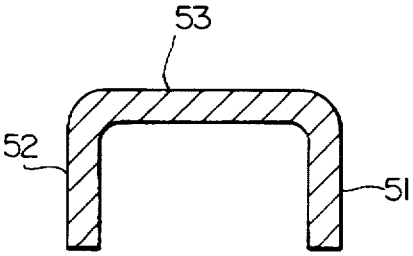
FIG. 17
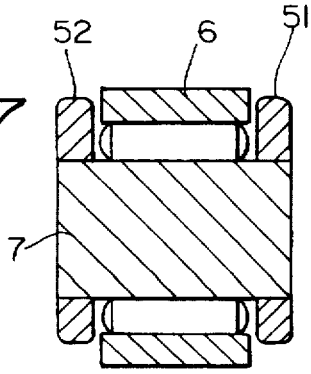

METHOD OF MANUFACTURING A ROCKER ARM

This is a divisional of patent application Ser. No. 08/621,706, filed Mar. 26, 1996, now U.S. Pat. No. 5,642,693, which is a continuation of patent application Ser. No. 08/271,778, filed Jul. 7, 1994 (now abandoned).

BACKGROUND OF THE INVENTION

This invention relates to a rocker arm manufactured by pressing which is rocked by a cam to open and close the valve of a cylinder head (hereinafter referred to merely as "a rocker arm", when applicable), and a method of manufacturing the rocker arm, and more particularly to an improvement for the rocker arm such that a rocker arm body has so-called "two-piece structure".

A rocker arm of so-called "one-piece structure" is known in the art in which three parts, namely, roller supporting side walls, a pivot engaging portion, and a valve engaging portion are formed as one unit by using one piece of metal plate, as disclosed by U.S. Pat. No. 5,016,582.

The known rocker arm is formed as follows: First, one piece of metal plate is blanked to obtain a base material which is substantially rectangular and has an opening at the center. The base material is bent and drawn on the press, to form the desired rocker arm. The valve engaging portion of the rocker arm is curved distinctively. Hence, it is difficult to shape the valve engaging portion as required, and even if the valve engaging portions are formed, they are not uniform in configuration. Therefore, there has been proposed a rocker arm having a so-called "two-piece structure" in which the valve engaging portion is separated from the remaining parts.

The term "two-piece structure" as used herein is intended to mean the structure which includes: a first piece comprising the roller supporting side walls and the pivot engaging portion; and a second piece which is the valve engaging portion.

The rocker arm having a "two-piece" structure has, however, the following disadvantages: In joining the second piece, namely the valve engaging portion, to the first piece, there is considerable difficulty in determining the position of the valve engaging portion. Hence, when the rocker arms are manufactured, they are not uniform with respect to the relative positions of the roller, the pivot engaging portion, and the valve engaging portion. The two piece rocker arms have a low manufacturing yield because the valve engaging portion, being distinctively curved, has no flat portion at all, and in joining the valve engaging portion to the first piece, it is difficult to obtain a reference point for positioning the valve engaging portion.

SUMMARY OF THE INVENTION

In view of the foregoing, an object of this invention is to provide a rocker arm comprising a roller, a pair of side walls for supporting the roller, a pivot engaging portion and a valve engaging portion in which the configuration of the valve engaging portion, and the relative position of the roller, the pivot engaging portion, and the valve engaging portion are set with high accuracy; and a method of manufacturing the rocker arm.

The foregoing object and other objects of the invention have been achieved by the following means:

The first means is a rocker arm in which a roller, with which a cam is slidably in contact, is rotatably provided in a rocker arm body at the middle as viewed in the longitudinal direction thereof; in which the rocker arm body is of a two-piece structure including:

a first piece which comprises a pair of side walls for supporting the roller, which are confronted substantially in parallel with each other, and a connecting portion through which, as viewed longitudinally of the rocker arm body, first end portions of the side walls merge with each other and which is formed with a curved valve-engaging portion; and a second piece which is a pivot engaging member fixedly secured to the remaining second end portions of the side walls, and the pivot engaging member being a flat plate having a semi-spherical portion formed by drawing.

The second means is a rocker arm adapted to be driven by a cam, the rocker arm comprising:

a one-piece main body including a pair of integral side walls extending parallel to each other and defining a longitude, and an integral connecting portion connecting the side walls to each other at a first end with respect to the longitude; and a pivot engageable plate separated from the main body and adapted to be fixed on the side walls at a second end opposite from the first end with respect to the longitude, the pivot engageable plate having a planer part and a semispherical part circumscribed by the planer part.

The third means is a method of manufacturing a rocker arm comprising the steps of:

blanking a piece of plate to obtain a base material for forming a rocker arm body, the base material being substantially U-shaped in a plan view having two protrusions which are substantially in parallel with each other;

bending the base material until the two protrusions are confronted substantially in parallel with each other, to provide a pair of side walls having a coupling portion between the side walls;

curving the coupling portion between the side walls, to provide a valve engaging portion; and fixedly securing to the free end portions of the side walls a pivot engaging member which is a flat plate having a semi-spherical portion formed by drawing.

In the rocker arm, the rocker arm body is of a so-called "two-piece structure" including the first piece which comprises the roller supporting side walls and the valve engaging portion, and the second piece which is the pivot engaging member provided separately from the first piece. Before the second piece, namely, the pivot engaging portion is joined to the first piece comprising the roller supporting side walls and the valve engaging portion, the first piece is substantially U-shaped in a plan view; that is, it is not annular. Hence, the valve engaging portion, which is distinctively curved, can be relatively readily formed.

The pivot engaging member is the flat plate having the semi-spherical portion corresponding in configuration to the pivot. The flat surface of the flat plate and the top of the semi-spherical portion can be utilized as reference points for positioning the pivot engaging member in joining the latter to the first piece of the rocker arm body. That is, in positioning the pivot engaging member, the reference points can be readily obtained.

The provision of the pivot engaging portion as a separate piece from the rest of the rocker arm allows finishing work to be carried out on the pivot engaging portion before it is welded to the rocker arm body. Hence, the final dimensions of the pivot engaging portion, as well as the final dimensions between the pivot engaging portion, the roller, and the valve engaging portion can be controlled more accurately than with prior rocker arms. The pivot engaging portion can also be welded to the rocker arm body in a position to accommodate an inclined lifter post without detrimentally affecting the accuracy of such final dimensions.

Finally, the provision of a separate pivot engaging portion allows for a reduction in the overall width of the finished rocker arm since the portions of the side walls between which the pivot engaging portion is welded have a rectangular cross section and do not have to be deformed to meet an integral pivot engaging portion as in the prior rocker arms.

BRIEF DESCRIPTION OF THE DRAWING(S)

FIG. 5 is a sectional view taken along line (5)—(5) in FIG. 3.

FIG. 6 is a sectional view taken along line (6)—(6) in FIG. 3.

FIGS. 7(*a*), 7(*b*), 7(*c*) and 7(*d*) are diagrams for a description of a process of manufacturing the rocker arm.

Figure 8:
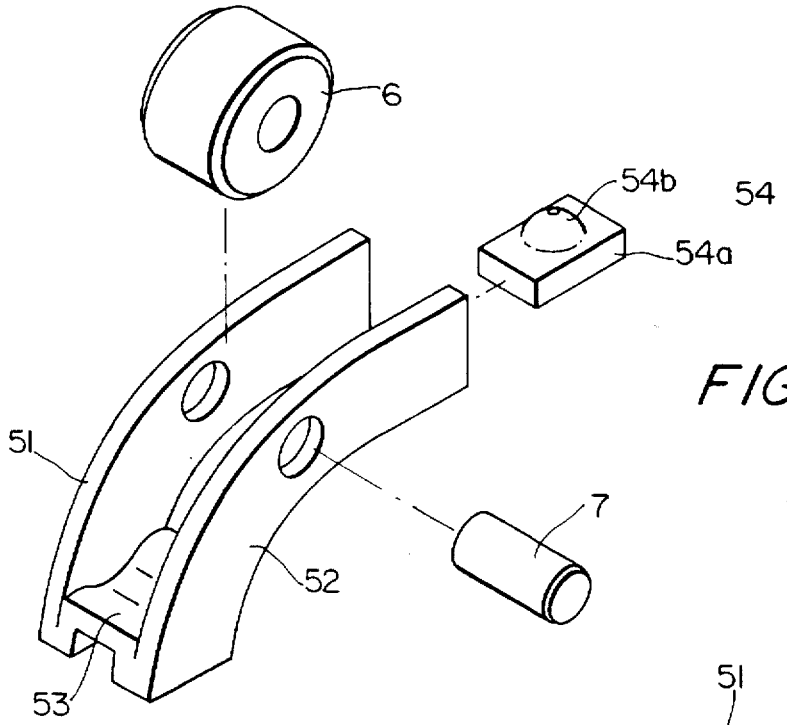

FIG. 8 is an exploded perspective view showing another example of the rocker arm, which constitutes a second embodiment of the invention.

Figure 9:
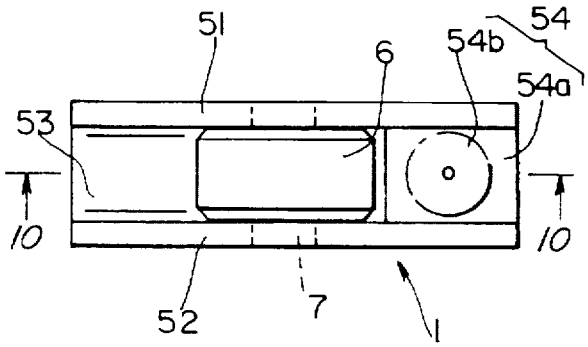

FIG. 9 is a plan view of the rocker arm shown in FIG. 8.

Figure 10:
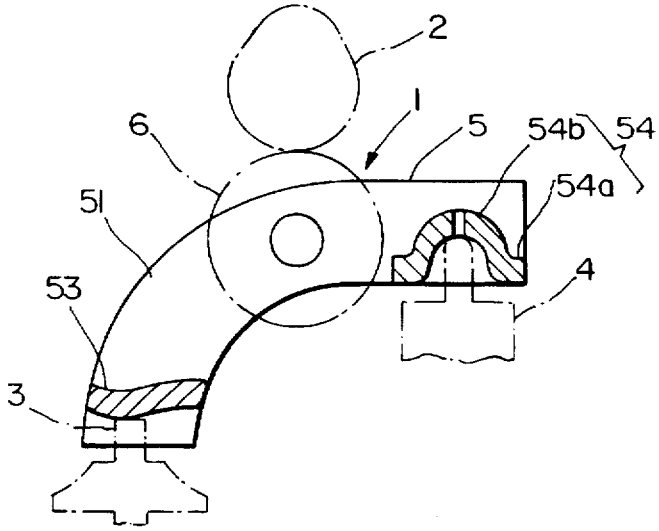

FIG. 10 is a sectional view taken along line (10)—(10) in FIG. 9.

Figure 11:
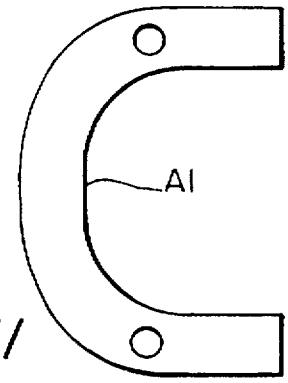

FIG. 11 is a diagram for a description of one manufacturing step in the manufacture of the rocker arm shown in FIG. 9.

FIG. 12 is a sectional view showing yet another example of the rocker arm, which constitutes a third embodiment of the invention.

FIG. 13 is a perspective view showing one modification of a pivot engaging member in the rocker arm of the invention.

FIG. 14 is a perspective view of still another example of the rocker arm, which constitutes a fourth embodiment of the invention.

FIG. 15 is a plan view of the rocker arm shown in FIG. 14.

FIG. 16 is a sectional view taken along line (16)—(16) of FIG. 15.

FIG. 17 is a sectional view taken along line (17)—(17) of FIG. 15

DETAILED DESCRIPTION OF THE PREFERRED EMBODIMENTS

Preferred embodiments of the invention will be described with reference to FIGS. 1 through 14.

An example of a rocker arm formed by pressing (hereinafter referred to merely as "a rocker arm", when applicable), which constitutes a first embodiment of the invention, will be described with reference to FIGS. 1 through 7.

Figure 4:
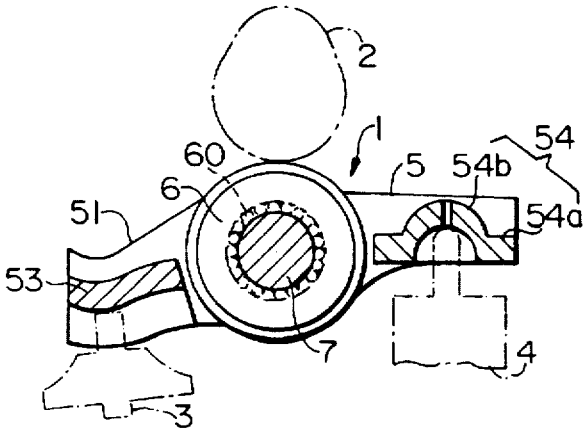
FIG. 4 is a sectional view taken along line (4)—(4) in FIG. 3.

In FIG. 4, showing the rocker arm which is in use, reference numeral 1 designates the rocker arm; 2, the cam of a cam shaft; 3, a valve stem; and 4, the pivot of a lash adjuster.

Figure 1:
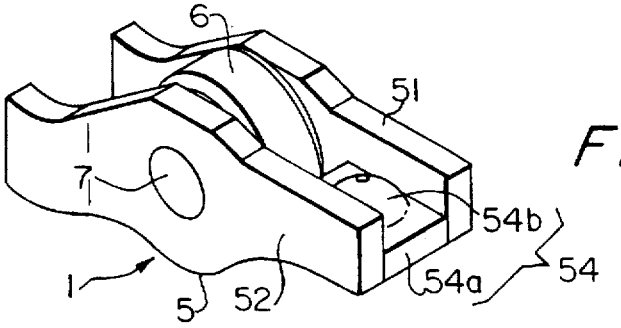
FIG. 1 is a perspective view of one example of a rocker arm, which constitutes a first embodiment of this invention.
Figure 2:
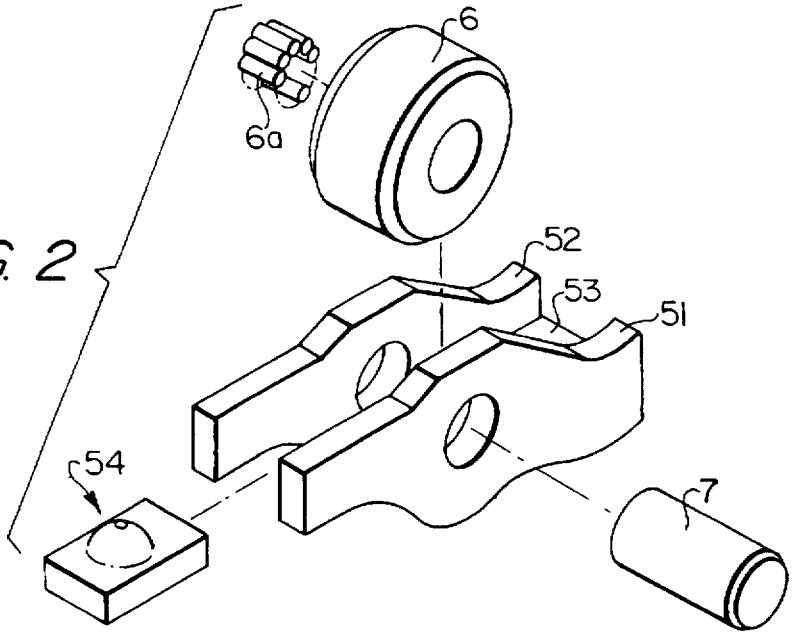
FIG. 2 is an exploded perspective view of the rocker arm.

Roughly stated, the rocker arm 1 comprises: a rocker arm body 5; and a roller 6 which is rotatably mounted in the former 5: The rocker arm body 5 is of so-called "two-piece structure"; that is, it, as shown in FIG. 2, consists of: a first piece (component) comprising a pair of right and left side walls 51 and 52 which are extended substantially in parallel with each other, and a connecting or coupling portion having a valve engaging portion 53, through which, as viewed longitudinally of the rocker arm body, first end portions of the right and left side walls 51 and 52 merge with each other; and a second piece (component) which is a pivot engaging member or pivot engageable plate 54 fixedly connected to the remaining second end portions (free end portions) of the right and left side walls 51 and 52. More specifically, the first piece is folded as shown in FIG. 6. That is, the valve engaging portion 53 is folded over the right and left side walls 51 and 52 as indicated at 50, thus forming valve guides 50*a* and 50*a* along the side walls 51 and 52.

The pivot engaging member 54, as shown in FIGS. 2 and 4, is a rectangular metal plate 54*a* having a semi-spherical portion 54*b* at the center which is formed by drawing. The semi-spherical portion 54 is to engage with the head of the pivot 4. The two long sides of the pivot engaging member 54 thus formed are welded to the inner surfaces of the right and left side walls 51 and 52.

Figure 3:
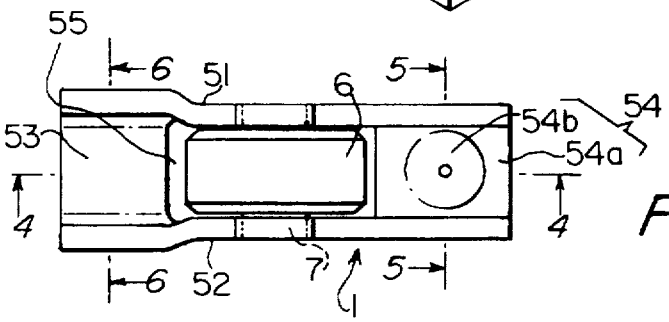
FIG. 3 is a plan view of the rocker arm.

The roller 6 is rotatably mounted on a shaft 7 supported by the right and left side walls 51 and 52; that is, the roller 6, as shown in FIG. 3, is arranged in a rectangular space 55 which is defined by the side walls 51 and 52, the valve engaging portion 53, and the pivot engaging member 54. A bearing 60 is provided between the shaft 7 and the roller 6. Preferably, the shaft 7 is fixedly secured to the side walls 51 and 52 by suitable means, for instance, by caulking axial ends of the shaft 7.

A method of manufacturing the above-described rocker arm will be described with reference to FIGS. 7(*a*) to 7(*d*).

First, as shown in FIG. 7(*a*), a base material A1 for forming the rocker arm body 5 is formed by blanking a piece of metal plate. The base material A1 is substantially U-shaped in a plan view, having two protrusions A2 and A3 which are substantially in parallel with each other. Furthermore, the base material A1 has through-holes 70 and 70, into which the roller supporting shaft 7 is to be inserted. As shown in FIG. 7(*b*), the base material A1 is bent right angles along the broken lines (FIG. 7(*a*)) in such a manner that the protrusions A2 and A3 are confronted in parallel with each other, to form the right and left side walls 51 and 52 having a coupling or connecting portion A4 between them. Thereafter, the portion A4 between the right and left side walls 51 and 52 is folded as shown in FIG. 7(*c*), to form the valve engaging portion 53. Next, as shown in FIG. 7(*d*), the pivot engaging member 54 formed separately is welded to the free end portions of the right and left side walls 51 and 52. Under this condition, the roller 6 is mounted on the right and left side walls 51 and 52 with a bearing 60 through the shaft 7. Thus, the rocker arm has been manufactured. The aforementioned through-holes 70 may be formed in the right and left sides walls 51 and 52 after the latter 51 and 52 have been formed by bending the base material A1 as described above. The curved surface is preferably formed on the valve engaging portion 53 simultaneously at the time of bending the coupling portion A4 to have the inverted-U-shaped transverse section as shown in FIG. 7(*c*), but may be formed thereon after the coupling portion A4 is bent to have the inverted-U-shaped transverse section as shown in FIG. 7(*c*). Also, without bending the coupling portion A4 to have the inverted-U-shaped transverse section as shown in FIG. 7(*c*), the coupling portion A4 may be curved to provide the valve engaging potion 53.

In the above-described first embodiment, in welding the pivot engaging member 54 to the free end portions of the right and left side walls 51 and 52, the reference point for determining the height of the pivot engaging member 54 may be located on the upper surface of the flat portion of the pivot engaging member 54, and the reference point for determining the position of the pivot engaging member 54 in the front-to-rear direction may be located on the top of the semi-spherical portion 54*b* of the pivot engaging member 54. Hence, the position of the pivot engaging member 54 relative to the positions of the roller 6 and the valve engaging portion 53 can be determined with high accuracy.

In addition, the position of the pivot engaging member 54 may be determined as follows: With the lower surface and the side surfaces of the flat portion of the pivot engaging member 54 as references, the guide surface for the head of the pivot 4, defined by the semi-spherical portion 54*b*, is set at a desired position and in a desired direction.

Another example of the rocker arm, which constitutes a second embodiment of the invention, is as shown in FIGS. 8 through 11.

In the second embodiment, the right and left side walls 51 and 52 of its rocker arm body 5 are different in configuration from those in the above-described first embodiment. Accordingly, in the second embodiment, the roller 6, the valve engaging portion 53, and the pivot engaging member 54 are different in relative position from those in the first embodiment. The second embodiment is suitable for a valve operating mechanism in which the valve 3 is positioned below the lash adjuster 4. The other arrangements and functions are fundamentally equal to those of the first embodiment. Roughly stated, the rocker arm may be manufactured substantially in the same manner as in the case of the first embodiment; that is, its manufacturing method is differently from the above-described method of the first embodiment only in that a base material A1' for forming the rocker arm body is obtained by blanking a piece of metal plate as shown in FIG. 11.

In the case of a valve operating mechanism in which the valve 3 is located above the lash adjuster 4, a third embodiment of the invention is applicable thereto, wherein the rocker arm body 5 is so formed that, as shown in FIG. 12, the right and left side walls 51 and 52 are extended downwardly from the valve engaging portion 53. In this case, it is unnecessary to fold the valve engaging portion 53 as indicated at 50 in FIG. 6, and accordingly the valve engaging portion 53 can be formed with high accuracy. In addition, the third embodiment may be modified such that the valve engaging portion 53 is folded to have a substantially U-shaped transverse section.

FIGS. 14 to 17 show a fourth embodiment which has a configuration similar to that of the first embodiment, but is different from the first embodiment in that the valve engaging portion 53 is located at and connected to the upper end portions of the first end portions of the right and left side walls 51 and 52. The valve engaging portion 53 of this embodiment is not bent as similarly to the third embodiment shown in FIG. 12, so that the combination of the valve engaging portion 53 and the first end portions of the side walls 51 and 52 forms a substantially inverted-U-shaped transverse section as shown in FIG. 16. Further, as shown in FIG. 17, a plurality of needle rolling elements are radially interposed between the inner circumference of the roller 6 and the outer circumference of the shaft 7 to form a bearing means. The shaft 7 is securely fixed to the side walls 51 and 52 by caulking the axial ends of the shaft 7.

While the first and second embodiments have been described, the invention is not limited thereto or thereby. For instance, the pivot engaging member 54 may be modified as shown in FIG. 13. That is, two side walls 54*c* and 54*d* are formed along the long sides of the flat portion of the pivot engaging member 54, respectively, in such a manner that they are extended upwardly and are confronted in parallel with each other. Alternatively, the side walls 54*c* and 54*d* may be extended downwardly.

In the rocker arm of the invention, the rocker arm body is of so-called "two-piece structure", including the first piece comprising the right and left side walls and the valve engaging portion between those side walls; and the second piece, namely, the pivot engaging member. Hence, the valve engaging portion can be readily formed, and the pivot engaging member can be secured to the first piece of the rocker arm body with ease. The configuration of the valve engaging portion, and the relative position of the roller, the valve engaging portion and the pivot engaging member can be set with high accuracy. Thus, the rocker arm of the invention is high not only in manufacturing yield but also in product reliability.

What is claimed is:

1. A method of manufacturing a rocker arm comprising the steps of:

blanking a piece of plate to obtain a base material for forming a rocker arm body, said base material being substantially U-shaped in a plan view having two protrusions which are substantially in parallel with each other;

bending said base material until said two protrusions are confronted substantially in parallel with each other, to provide a pair of side walls having a coupling portion between said side walls;

curving said coupling portion between said side walls, to provide a valve engaging portion; and fixedly securing to the free end portions of said side walls a pivot engaging member which is a flat plate having a semi-spherical portion formed by drawing.

2. The method according to claim 1, wherein said step of bending includes the step of:

bending and folding said coupling portion to have a substantially U-shaped transverse section.

3. The method according to claim 1, wherein said step of bending includes the step of:

bending and folding said coupling portion to have a substantially inverted-U-shaped transverse section.

4. The method according to claim 1, further comprising the step of:

simultaneously with said blanking step, perforating said piece of plate to form shaft insertion through-holes in said protrusions of said base material.

5. The method according to claim 4, further comprising the step of:

inserting a shaft for supporting a roller into said shaft insertion through-holes such that said roller is supported between said side walls and a plurality of needle rolling elements are radially interposed between said shaft and said roller.

6. The method according to claim 5, further comprising the step of:

fixing said shaft onto said side walls by caulking axial ends of said shaft.

7. The method according to claim 1, further comprising the step of:

after said step of fixedly securing, forming shaft insertion through-holes in said side walls.

8. The method according to claim 7, further comprising the step of:

inserting a shaft for supporting a roller into said shaft insertion through-holes such that said roller is supported between said side walls and a plurality of needle rolling elements are radially interposed between said shaft and said roller.

9. The method according to claim 1, wherein said step of curving includes the step of:

bending and folding said coupling portion to have a substantially U-shaped transverse section.

10. The method according to claim 1, wherein said step of curving includes the step of:

bending and folding said coupling portion to have a substantially inverted-U-shaped transverse section.

* * * * *